US006705467B1

(12) United States Patent
Kancsar et al.

(10) Patent No.: US 6,705,467 B1
(45) Date of Patent: Mar. 16, 2004

(54) BLISTER PACKAGE

(75) Inventors: Peter Kancsar, Zurich (CH); Laurenz Zellweger, Zurich (CH); Michael Krohn, Zurich (CH); Claudia Schmauder, Zurich (CH); Susanne Marti, Zurich (CH)

(73) Assignee: Alcan Technology & Management Ltd., Neuhausen am Rhienfall (CH)

( * ) Notice: Subject to any disclaimer, the term of this patent is extended or adjusted under 35 U.S.C. 154(b) by 0 days.

(21) Appl. No.: 09/926,581

(22) PCT Filed: May 13, 2000

(86) PCT No.: PCT/EP00/04320

§ 371 (c)(1),
(2), (4) Date: Jun. 3, 2002

(87) PCT Pub. No.: WO00/75043

PCT Pub. Date: Dec. 14, 2000

(30) Foreign Application Priority Data

Jun. 2, 1999 (EP) ..... 99810479

(51) Int. Cl.[7] ..... B65D 83/04
(52) U.S. Cl. ..... 206/531; 206/539
(58) Field of Search ..... 206/528, 530, 206/531, 532, 534, 538, 539, 820

(56) References Cited

U.S. PATENT DOCUMENTS 4,429,792 A * 2/1984 Machbitz ..... 206/531
5,091,035 A * 2/1992 Anhauser ..... 206/531
5,150,793 A 9/1992 Tannenbaum
5,244,091 A 9/1993 Tannenbaum
5,529,188 A * 6/1996 Coggswell ..... 206/531
5,613,609 A * 3/1997 Hamilton et al. ..... 206/531
5,758,774 A 6/1998 Leblong
6,021,901 A * 2/2000 Wolfe ..... 206/531
6,394,275 B1 * 5/2002 Paliotta et al. ..... 206/531

FOREIGN PATENT DOCUMENTS

WO WO 96-03329 2/1996

* cited by examiner

*Primary Examiner*—Luan K. Bui
(74) *Attorney, Agent, or Firm*—Fisher, Christen & Sabol

(57) ABSTRACT

A blister package (1) with a bottom part (2) with at least one depression (3) and a cover film (6) that is fastened to the bottom part (2), covers the depressions (3) and can be forced through, the depressions (3) containing a product to be withdrawn. A cover layer (7) covers the cover film (6) and contains sections that can be forced through and others that cannot be forced through. The depression (3), in the rest position of the blister package (1), is located at least partially or completely above a section of the cover layer (7) that cannot be forced through. In order to expose the product to be withdrawn, the depression is displaced across a section (8) in the cover layer (7) that can be forced through by way of a lateral movement with respect to the cover layer (7). The product to be withdrawn can then be forced through the cover film (6) and the cover layer (7).

15 Claims, 4 Drawing Sheets

BLISTER PACKAGE

Figure 1A:
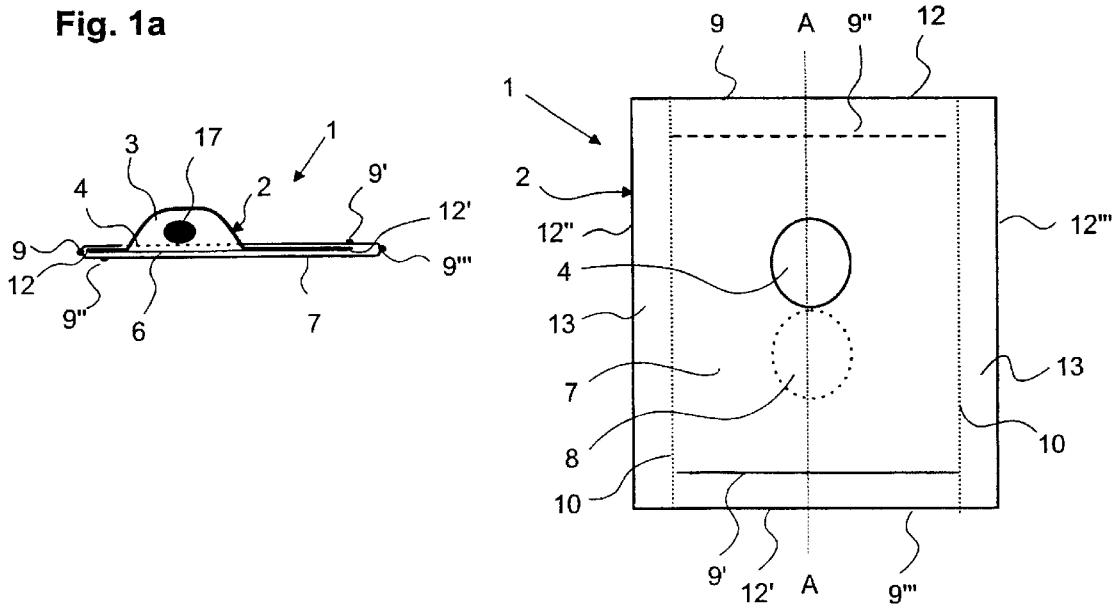

This is a 371 of International Application No. PCT/EP00/04320, filed on May 13, 2000, that has benefit of European Patent Application No. 99810479.8, filed on Jun. 2, 1999.

The present invention relates to a push-through pack, containing a base part comprising at least one surface element and at least one recess, a push-through cover film affixed to the base part and covering at least the recess opening of the recess, and a cover layer which overlays the cover film on the outside, and the cover layer contains non-push-through and push-through sections, and the recess is located at least partially over a non-push-through section in the cover layer when the push-through pack is undisturbed, and means are arranged to expose the content by way of which means the recess opening can be brought over a push-through section in the cover layer by movement relative to the cover layer so that the content can be pushed through the cover film and the push-through section in the cover layer. The invention further relates to the use of a push-through pack.

The closure of base parts, also known as product carriers, of push-through packs or blister packs, using push-through cover films, made, for example, of metal such as aluminum, is familiar. The cover film may be an aluminum foil coated with a sealing layer, such as a sealing lacquer. The aluminum foil is sealed over the sealing layer onto the base part, for example, by heat-sealing.

To remove the contents, these are pushed against the cover film by deforming the recess, causing the cover film to tear or burst, thereby releasing the content or filling. This means that the cover film must be inelastic and easily tearable. Thus, aluminum foils modified with a sealing layer are especially suitable for this purpose. The packs described contain, for example, medicaments such as pills, tablets, dragees, ampoules and the like.

The contents, in particular medicaments, in their habitually colorful forms of administration that resemble sweets, arouse the curiosity of children. In order to prevent children from gaining access to special medicaments, it is often appropriate to make their opening manipulation difficult. Said cover films have the disadvantage that the intended ease with which they may be pushed through constitutes a not insurmountable obstacle, even for-children, to the removal of the contents from the packaging.

A child-safe pharmaceutical packaging comprising a base foil, a push-through foil and a safety foil is known from DE-A-29 19 713. The contents cannot be removed from the pack by pushing it through without first completely removing the safety foil, for example by peeling it off, which can however be difficult even for adults, in particular elderly persons.

U.S. Pat. No. 5,150,793 describes a child-safe packing of a base part with several recesses, where the recesses are covered with a push-through film. On the push-through film is provided a further cover film with openings. In the edge area of the packing is arranged a housing in which are arranged spring means to move the base part relative to the cover film. In the undisturbed position, the recesses lie over non-push-through sections of the cover film. To remove the contents, the base part or recesses can be moved over the openings in the cover film by a sliding force against the spring pressure.

The present invention seeks to create a push-through pack which cannot be opened by children, but which is nevertheless easy for elderly persons to use and to open.

The problem is solved by the invention in that a cover layer is connected at two opposing side edges or side edge areas of the surface element to the base part and contains fold lines at which the cover layer can be shifted and folded up in the manner of a parallelogram by a movement relative to the surface element, so that when folded up the recess opening comes to lie on a push-through section in the cover layer.

The term push-through is preferably understood as manually push-through.

The push-through pack according to the invention suitably contains a base part with at least one or a multiplicity of for example cornered, round or oval recesses, also known as compartments or cups. The base part may for example be rectangular when viewed from above, with the recesses preferably being evenly distributed and arranged in lines and rows.

In a preferred embodiment, the push-through pack has weakening lines, preferably perforations, preferably running crosswise and lengthwise, which enclose or delimit sections, for example rectangular surface elements with at least one, and preferably precisely one, recess. Individual such sections can be manually separated from such a pack as single or multiple portions, preferably along the weakening lines.

Weakening lines are target separation lines or target separation areas along which the material can be separated, preferably manually. The weakening lines are produced for example using mechanical means, such as cutting, stamping or scratching with knives, using physical means such as for example heat treatment, laser beaming, electron beaming, electrical discharge machining, dissolution, or swelling using solvents or through chemical reaction, e.g. by etching. The weakening lines can accordingly be areas in a foil which are completely or partially separated or are weakened through a change in the structure of the material and through abrasion of the material.

The surface elements are preferably rectangular or preferably have a geometry similar to the rectangular shape.

In a preferred embodiment, the push-through pack contains two lines of recesses, so that at least one edge of each surface element containing a recess forms a section of the edge of the push-through pack.

The base parts of this blister pack can be embossed, cast, deep- or stretch-drawn or vacuum-molded base parts made of metal such as aluminum, plastic, plastic/paper composites or plastic/metal composites. The plastics may be plastics coated with inorganic layers, in particular with $SiO_x$.

Suitable plastics for base parts are, for example, thermoplastics containing foils and foil composites on an olefin basis, such as polyethylene, polypropylene or copolymers thereof, on an ester basis, such as polyethylene terephthalates, polyamides or halogen-containing plastics such as polyvinyl chloride or polyvinylidene chloride or mixtures thereof. The base parts may also have a barrier layer against gases and vapors. Such a barrier layer may be, for example, a metal foil, such as an aluminum foil or a ceramic or metal layer arranged between two plastic layers, embedded in a plastic composite. Ceramic or metal layers may be, for example, produced by vaporizing metals, oxides or nitrides of aluminum, silicon and other metals and metalloids in a vacuum, and depositing the materials on a plastic carrier.

The base part may also be manufactured from or using materials containing cellulose, such as paper, cardboard, molding materials containing paper, or be reinforced with the aid of such materials.

In a preferred embodiment, the base part consists of or contains polyvinylchloride (PVC), PVC coated with polyvinylidene chloride (PVdC), cyclo-olefin copolymer (COC)

or polychloro-trifluoroethylene (PCTFE). Composite foils with PCTFE, in particular with PCTFE and PVC, are also preferred. The total thickness of the base part is for example 100–500 mm, in particular 200–360 mm.

Further preferred foil composites for base parts contain or consist of an external foil made of PVC of a thickness of 60–100 mm, a further external foil made of oriented polyamide (oPA) of a thickness of 25–30 mm and an intermediate foil made of aluminum of a thickness of 4560 mm. In addition, foil composites, each with an external foil made of polypropylene and an intermediate foil made of aluminum, may be used.

The cover film is push-through over the recess opening. It preferably comprises an aluminum foil, in particular, an aluminum foil modified with a sealing layer. An aluminum foil of a thickness of 15–30 mm, preferably 18–22 mm, coated with a hot-seal lacquer, is preferred.

The cover film may also contain or comprise plastics such as have been described for the base part. The plastic cover film may also be made of sealable plastic or may carry a sealing layer. Furthermore, in particular for single product packs, push-through cover films made of plastics or metal films or layers of low resilience and with poor extension characteristics may be used. Such plastics are for example achieved by mixing large quantities of fillers with the plastic.

The cover film may also be a foil which is difficult or impossible to push through, which has weakening lines, such as perforations, for example in the area of the recess opening, which serve as tear edges and which permit the contents to be pushed through.

The cover film covers for example all or part of the base part and seals at least the recess openings.

The cover film is suitably combined with the base part by gluing or sealing. Sealing layers or sealing foils may be used for sealing. The sealing layer may contain or comprise a thermoplastic plastic, for example from the series of polyolefins or copolymers or terpolymers of ethylene. The sealing layer may also contain a coupling agent or primer.

Adhesives may for example be phenol resins, epoxy resins, cyanoacrylates, acrylates, modified acrylates and in particular polyurethane-based adhesives. The above-mentioned sealing lacquers may for example be used as sealing lacquers.

The blister pack may for example contain a surface element with a single recess. The surface element is further provided with a cover layer, which covers the cover film when the push-through pack is undisturbed, for example covers it tightly.

In a further embodiment, the base part of a push-through pack may also contain several recesses evenly arranged in lines, where the push-through pack is divided into surface elements, each containing a recess, and a cover layer is appropriately assigned to each surface element, which covers the cover film when the push-through pack is undisturbed, for example covers it tightly.

The cover layer may for example be a monofilm or a foil or coating composite. It has non-push-through sections and represents a safety precaution, to ensure that the contents of the recesses cannot be pushed through the cover film without additional prior opening steps. In addition, the cover layer suitably also has push-through sections, where the recess or the recess opening lies above a non-push-through section of the cover layer when the push-through pack is undisturbed.

The cover layer may consist of one of the above-mentioned materials which are appropriate to the base part. The cover layer may also consist of the same material as the base part. In addition, the base part and the cover layer may be manufactured from a single material cut-out.

The cover layer further advantageously contains materials made of cellulose, such as for example, paper, cardboard, molding materials containing paper, etc.

The cover layer is preferably made of card, which is for example coated or lined with one of the above-mentioned plastics. The coating is for example produced using coating processes such as extrusion coating, dispersion coating or lacquering processes. The coating may be a lacquer, a wax, a paraffin or a hot melt coating. Lining processes may also be used, in order to combine a strip of card with for example a semi-finished plastic foil.

At the non-push-through sections, the cover layer resists the habitual push-through forces which have to be applied in order to remove the contents from a push-through pack. The resistance of the cover layer may derive from its tear resistance and/or its high resilience.

The cover layer suitably contains a rectangular-shaped flat part, with a certain intrinsic rigidity, so that the flat part retains a constant surface evenness without additional deformation forces.

In the case of a base part made of a surface element with a recess, the cover layer is for example combined with it along a first and a second opposite side edge or side edge area of the surface element, for example by way of an adhesive connection or seal. The connection is suitably designed as an adhesive or sealed seam extending over the entire length of the side edge. Possible adhesives are for example said adhesives.

The side edge area may be understood as a flat area close to the side edge, which may for example be located on the concave side (the side on which the recess is recessed) or the convex side (the side on which recess projects) of the surface element or base part.

A first and second fold line are preferably arranged at a first, and opposite this a second, side edge in the cover layer or base part, and a third and fourth fold line arranged each offset from the first and second side edge by the length of an up side in the cover layer or base part.

The cover layer and if necessary the surface element or base part may have fold lines or bending zones, at which the cover layer or if necessary sections of the surface element can be bent, in such a way that the cover layer is folded up relative to the surface element in the manner of a parallelogram and the surface element or the recess can be displaced sideways relative to the cover layer. Viewed in cross section, the cover layer and the base part enclose a preferably rectangular-shaped space in the fully folded up state, each with an up side.

The fold lines are areas in which parts of the material bend particularly well, although they suitably cannot be separated. The fold lines should be impossible or difficult to separate, especially manually, so that the push-through pack cannot in error be separated along the fold lines.

The cover layer suitably has four fold lines, where two of these are for example arranged at the edge of the connection seam along both side edges of the surface element and a third fold line is located in the cover layer offset from the first side edge by the length of one up side. When the cover layer is folded up, this third fold line is displaced towards the first side edge of the surface element. There may also be a fourth fold line in the cover layer, where in this alternative the cover layer extends over the second side edge of the surface element by the length of the up side and the fold line is the bending point of the cover layer, the reverse end of which is fixed to the second side edge or side edge area of the surface element. The fourth fold line may also be in the surface element or base part itself, suitably offset from the second side edge by the length of the up side, where in this case the cover layer does not extend beyond the side edge of the surface element. When the cover layer is folded up, in this case the surface element is itself bent along the fold line.

If the surface element or base part continues to be displaced relative to the cover layer in the same direction after the cover layer has been completely folded up, the cover layer folds down flat again on the other side in the manner of a parallelogram. If the cover layer is folded completely over onto the other side, the recess in the base part preferably comes to lie on a push-through flat area in the cover layer. As a result, removal of the contents is made possible, in that it can be pushed through both the cover foil and through the cover layer using habitual pushing through force.

In order to ensure that it is not possible to fold the cover layer in the manner of a parallelogram when the push-through pack is undisturbed, the cover layer is suitably connected to the surface element or the push-through pack by way of a connection seam which is for example continuous and separable, referred to below as the separable connection seam, along at least one of the other free side edges, i.e. the third and fourth side edges, or side edge areas. The separable connection seam may extend over the entire side edge of the surface element or over partial areas thereof.

The separable connection seam is preferably provided with a weakening line, such as a perforation, which permits the separable connection seam to be removed from the push-through pack with one or a few manipulations and thus to separate the connection. The separable connection seam suitably serves as tamper-proofing and guarantees the push-through pack against displacement or folding up of the cover layer and holds the cover layer secure on the concave side of the push-through pack. It is for example an adhesive or sealed connection along a long side, for example of the quality described above.

Other, in particular detachable, connections may however be provided, which fix the cover layer to the surface element or to the push-through pack, for example at the sides, when the push-through pack is undisturbed. Instead of separating a connection seam, provision may be made for the connection to be opened, for example after peeling off a cover layer.

In addition, the cover layer lying on the concave side of the push-through pack may be affixed in a detachable manner to the push-through pack using an adhesive. This adhesive connection must first of all be detached before the recess opening can be displaced to cover a push-through area in the cover layer.

A base part of a push-through pack, divided into surface elements, which has several evenly arranged recesses, may also be provided with cover layers of the type described above.

The surface elements are for example bordered in a mutually separable manner by way of weakening lines such as perforations. The weakening lines form the side edges of the surface elements. Each surface element or a group of surface elements, in particular a row of surface elements, is for example assigned a cover layer made of a material cut-out, where in the last case the individual cover layers of such a group of surface elements are bordered by weakening lines from the cover layers of the adjacent surface elements. In the same way as in the embodiment described above for example, the cover layer is connected to the surface element along two opposing side edges thereof, for example by way of an adhesive connection or seal of the type described above.

The designation of the elements of individual surface elements is the same as that in the above description of a push-through pack with a single surface element. The cover layer has fold lines or bending zones of the type and position described above, where the fourth fold line is preferably located in the surface element offset from the second side edge of the surface element by the length of an up side.

As previously described, each surface element has for example at least one separable connection seam. This may for example be arranged at the side edge or side edge area of the push-through pack, which is simultaneously the side edge of a line of surface elements. In addition, a separable connection seam common to two adjacent surface elements, which extends over the entire length of the line and is delimited by way of two weakening lines such as perforations from the adjacent separable surface elements, may also exist between two lines of recesses or surface elements.

In order to make the content of a recess accessible, the surface element is preferably separated from the remainder of the push-through pack along the weakening line. The surface element is preferably simultaneously separated from a separable connection seam arranged between two lines of surface elements. The act of removing for example a second opposing separable connection seam, which in this case lies along a side edge or side edge area of the push-through pack, allows the cover layer of the surface element to fold up in the manner of a parallelogram, as described, and the recess to be displaced to cover a push-through section in the cover layer.

If only one common separable connection seam for two lines of surface elements lies between two lines of surface elements of a base part, then an initial opening stage is performed when the surface element is detached from the push-through pack. However, if it is to be possible for the surface element to be detached intact from the remainder of the push-through pack, then two separable connection seams are suitably provided between two lines of surface elements, which are then mutually separated by a separable perforation, so that each surface element, together with its separable connection seam, can be detached from the remaining push-through pack.

A push-through pack may also have several lines of surface elements with separable connection seams located between them.

In a further embodiment, provision may be made for the surface element not to have to be separated from the remainder of the push-through pack in order to release the content of the recess, i.e. for the cover layer to be folded up in the manner of a parallelogram.

In a further embodiment, provision may be made for the displacement of the recess opening over the push-through flat area in the cover layer not to take place by way of the parallelogram-type folding up of the cover layer as described above, but for example by way of a purely lateral relative movement of the recess or of the surface element across the cover layer. Separable connection seams at the sides, or detachable connections, fix the cover layer for example to the concave side of the push-through pack, in such a way that the cover layer cannot be displaced until these connections are removed. The displacement is for example made possible by providing resilient sections in the cover layer.

The push-through area in the cover layer may for example be a section in the cover layer which is of low resilience and has poor expansion characteristics, so that the cover layer tears at this point in response to normal pushing-through forces. The push-through section may however also be a dip in the cover layer.

The push-through section in the cover layer may moreover also be created by producing a weakening line, for example a perforation, which partially or fully encloses a specific section. When pushing-through force is applied, the push-through section is torn away from the cover layer along the perforation, so that the section concerned falls out of the cover layer or only remains hanging off the cover layer in places.

The size of the push-through section is dimensioned in such a way that the contents can be pressed through it. Moreover, the push-through section should be at most sufficiently large for it not to be covered if possible, or only minimally covered by the recess opening, when the push-through pack is undisturbed.

The push-through pack preferably has lettering and graphic elements at corresponding points on its outside, which disclose to the user inter alia the individual opening stages. The cover layer may moreover be designed in such a way that the push-through sections cannot be visibly distinguished from the non-push-through sections.

The base parts are for example produced as endless material, filled with the contents and the cover film also applied to the base parts as endless material. The entire surface of the cover film is combined with the base part, covering the recess openings, by sealing or gluing. In subsequent procedural steps, the endless strip may be cut into packaging lengths and the cover layer applied, in a number of different sequences. The same opportunity may be taken to produce weakening and/or fold lines on the push-through packs.

The contents of a pack according to the present invention may not be removed, i.e. pushed-through the cover film out of the recess, until a designated sequence of opening manipulations has been completed. This is a virtually insoluble task for children, whilst the opening of such a pack is relatively easy for elderly people to manipulate. Displacing the recess opening until it is above a push-through section in the cover layer in particular is a manipulation which is not undertaken intuitively, but requires certain prior knowledge or the ability to read the instructions on the pack.

Figure 2A:
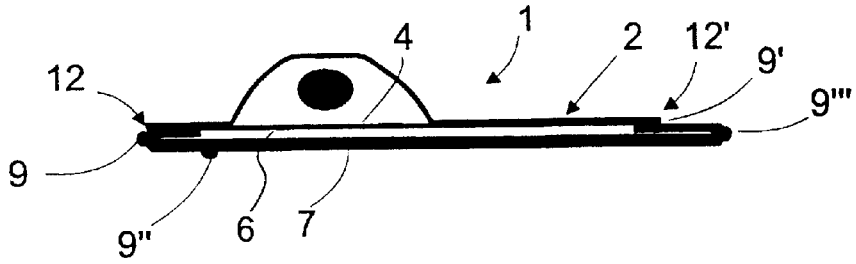
Figure 2B:
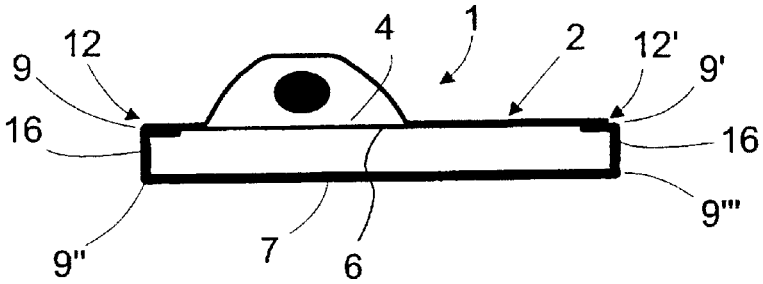
Figure 3A:
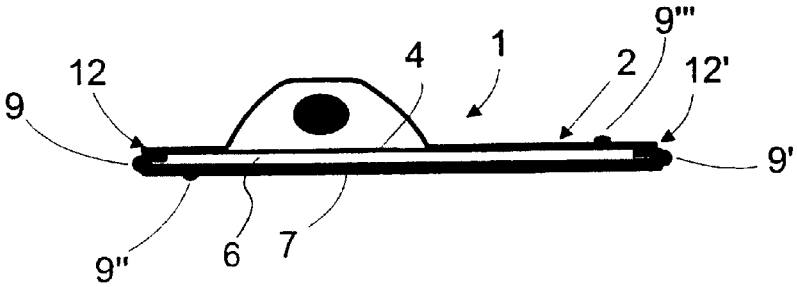
Figure 3B:
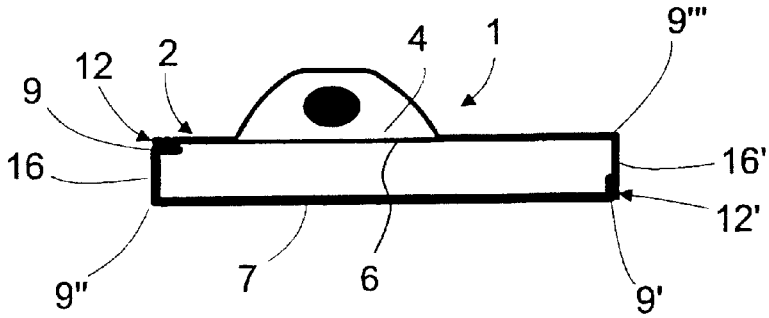
Figure 4:
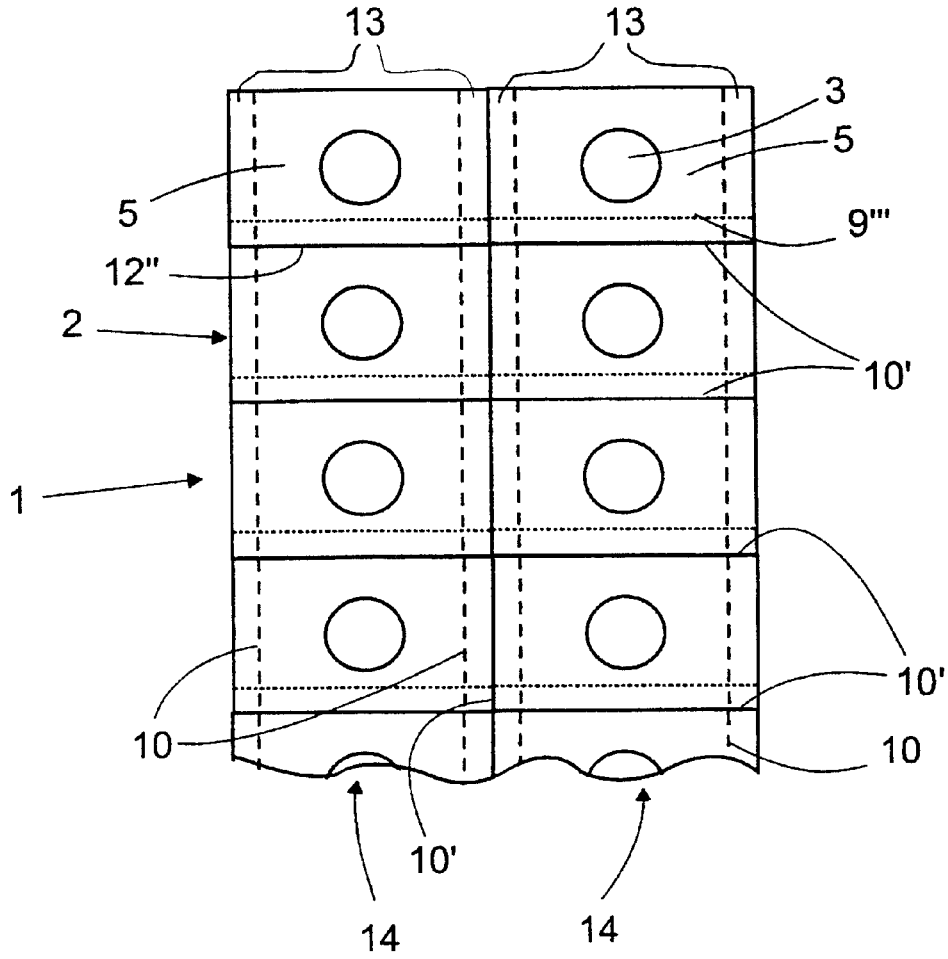

The invention is explained below using examples and with reference to the attached drawings, in which:

FIG. 1*a–d*: show a push-through pack and a diagrammatic representation of the opening procedure, where the individual steps involved in opening the push-through pack are shown both from above and in cross section along the line A—A;

FIG. 2*a–b*: shows a cross section of a further form of embodiment of a push-through pack with the cover layer folded down flat and folded up;

FIG. 3*a–b*: shows a cross section of a further form of embodiment of a push-through pack with the cover layer folded down flat and folded up;

FIG. 4: shows a view from above onto a push-through pack with a number of recesses or surface elements.

The push-through pack 1 in FIG. 1*a* is designed as a surface element, comprising a rectangular base part 2 and a recess 3. The recess 3, and together with it a content 17 contained therein, is covered with a push-through cover film 6 made of an aluminum foil coated with lacquer, which is sealed onto the base part 2.

The base part 2 is wrapped both on the convex side (side on which the recess projects) and on the concave side (side on which the recess is recessed) with a cover layer 7 made of plastic-coated card comprising a single cut-out, where the recess 3 projects through a dip in the cover layer 7. The cover layer 7 is mutually glued or sealed to its opposing abutting side edge areas on the concave side of the push-through pack 1, so that a continuous enclosed wrapping of the base part 2 is formed.

¼ of the packaging material of the push-through pack 1 consists of a blister film, for example plastic or a plastic and metal composite, from which inter alia the base part 2 is made, and ¾ of it consists of plastic-coated card, from which inter alia the cover layer 7 is made.

The cover layer 7 is combined with the section laying on the convex side of the base part 2 by way of gluing or sealing to the base part 2. The cover layer 7 has a first and second fold line 9, 9' in the area of a first and second side edge 12, 12' or side edge area of the base part 2. In addition the cover layer 7 has a third fold line 9" offset by the length of an up side 16 (see FIG. 1*b*) from the first side edge 12 of the base part 2, and a fourth fold line 9'" also offset by the length of an up side 16 from the second side edge 12' of the base part 2. The cover layer 7 extends along the second side edge 12' or side edge area beyond the second side edge 12' of the base part 2 by the length of an up side 16, where the bend point in the cover layer 7 is simultaneously the fold line 9'".

Figure 1B:
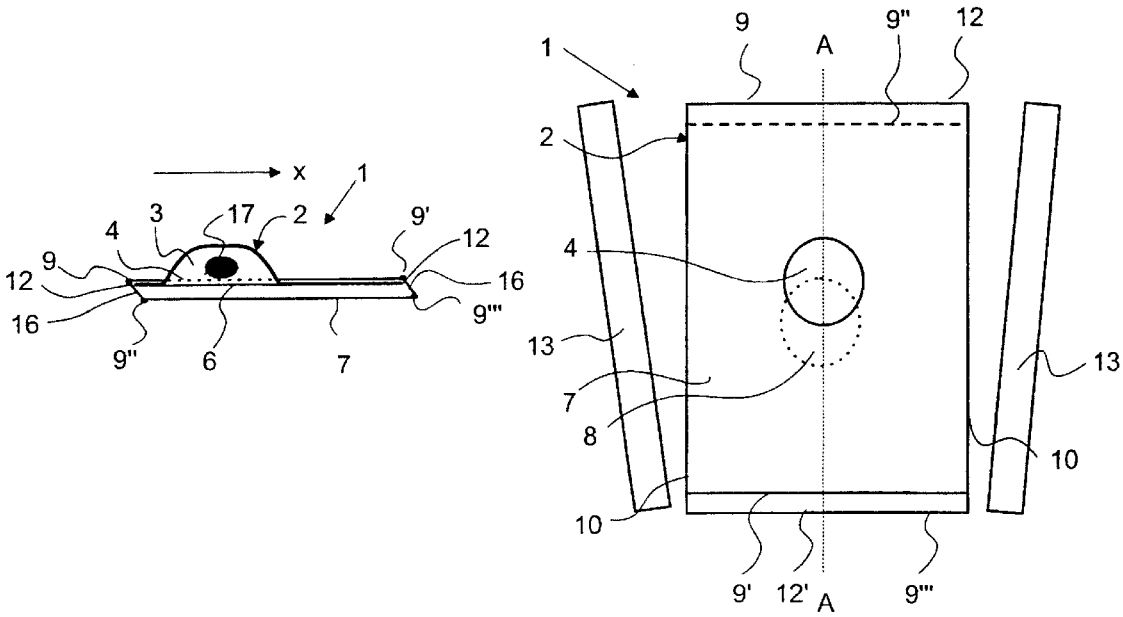

Each of a third and fourth side edge 12", 12'" or side edge area of the base part 2 or the blister pack 1 has a separable sealed or adhesive seam, a so-called separable connection seam 13, which can be detached from the blister pack along a weakening line 10, such as a perforation (FIG. 1*b*). The separable connection seam 13 is a flat connection between cover layer 7 and base part 2.

Figure 1C:
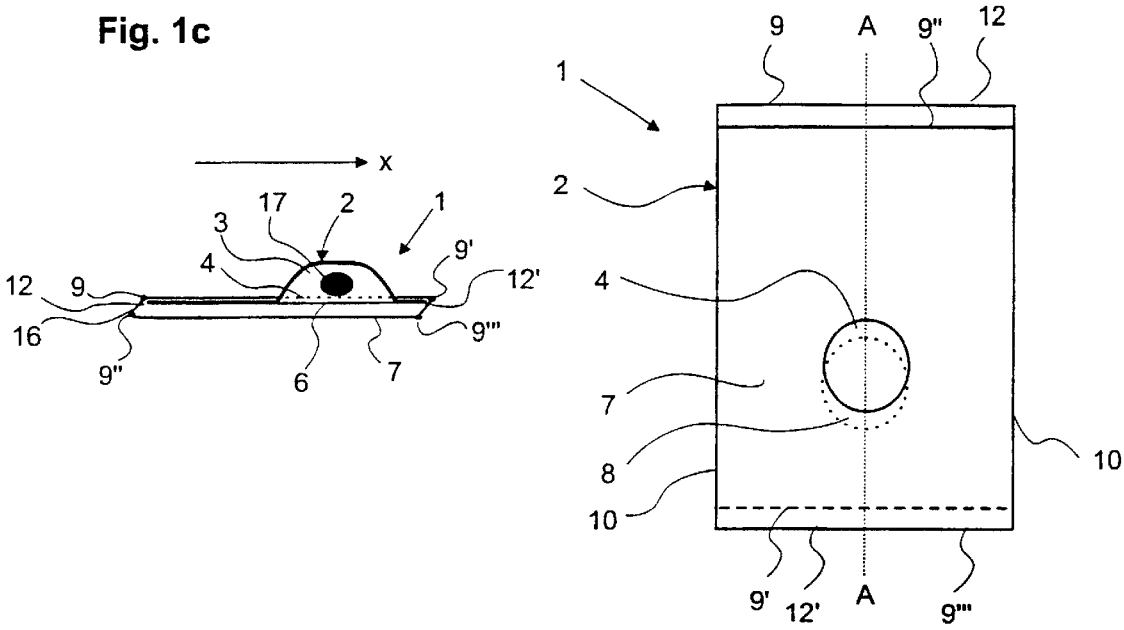
Figure 1D:
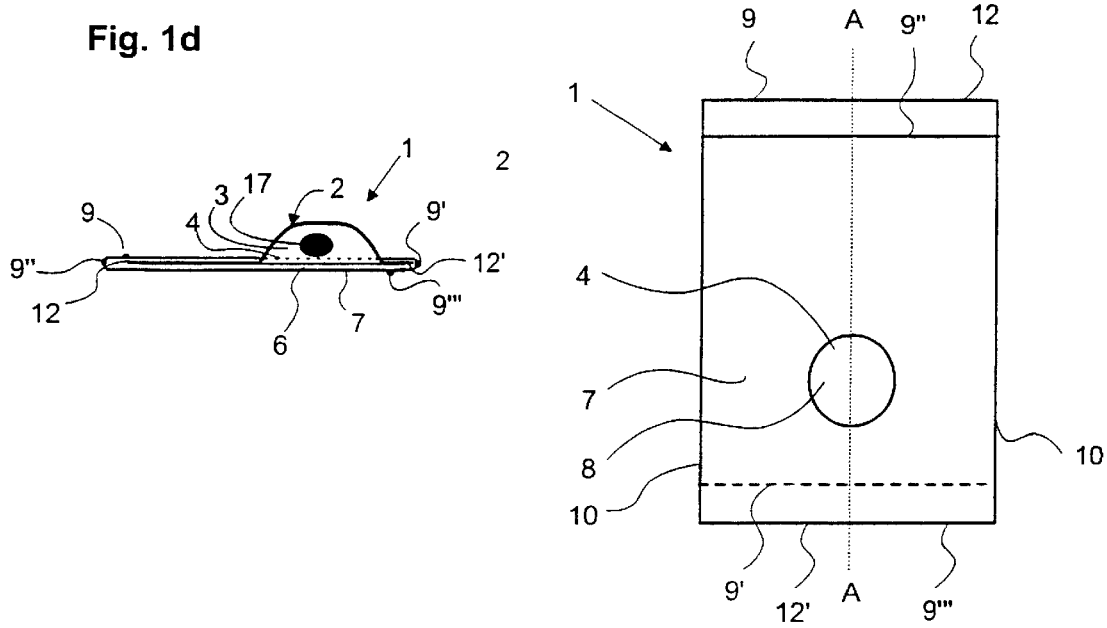

After detaching the separable connection seams 13, the cover layer 7 may be folded up in the manner of a parallelogram with turning axes along the fold lines 9, 9', 9', 9'", forming up edges 16 in direction x, and folded over onto the other side (FIGS. 1*b*, 1*c*, 1*d*).

A perforated, push-through section 8 is provided on the concave side of the base part 2 in the cover layer 7, in such a way that it comes to lie on and entirely covers the recess opening 4 in the base part 2 through the folding up and over of the cover layer 7 in the manner of a parallelogram (FIG. 1*d*).

The contents 17 can now be pushed through the cover film 6 and the cover layer 7, i.e. through the push-through section 8 in the cover layer 7, and removed from the push-through pack.

In a further embodiment, the cover layer 7 may be restricted to the concave side of the base part 2 and affixed to it, for example by way of gluing or sealing.

In a first alternative, the cover layer 7 is glued or sealed to the concave side of the base part 2 with an area overlapping the base part 2. A first and second fold line 9, 9' in the cover layer 7 are located in the area of the first and a second side edge 12, 12' of the base part 2, where the first fold line 9 is also the bend point of the cover layer 7. A third fold line 9" is located in the cover layer 7 offset by the length of an up side 16 (see FIG. 2*b*) from the first side edge 12. A fourth fold line 9'" is located in the cover layer 7 offset by the length of an up side 16 from the second side edge 12'. The cover layer 7 extends beyond the second side edge 12' at the second side edge 12' by the length of an up side 16, where the fold line 9'" is also the bend point of the cover layer 7, the return end of which is fixed by way of gluing or sealing to a flat area overlapping the base part 2 in the area of the second side edge 12'.

In FIG. 2*b* the cover layer 7 of push-through pack 1 is folded up fully. By folding it over onto the other side, the recess opening 4 comes to lie on a push-through surface in the cover layer 7 (not shown in FIG. 3), in the same way as in the alternative embodiment described above.

In a second alternative, the cover layer 7 is glued or sealed to an area on the concave side of the base part 2 which overlaps the base part 2 in the area of a first side edge 12. Two fold lines 9, 9' in the cover layer 7 are located in the area of the first and a second side edge 12, 12' of the base part 2 (FIG. 3*a*), where both fold lines 9, 9' are also bend points of the cover layer 7. A third fold line 9" is located in the cover layer 7 offset by the length of an up side 16 (see FIG. 3*b*) from the first side edge 12. A fourth fold line 9'" is located in the base part 2 offset by the length of an up side 16' from the second side edge 12'. The cover layer 7 does not extend beyond the second side edge 12', but has its bend point on both sides in the area of the side edges 12, 12'. In FIG. 3*b* the cover layer 7 of the push-through pack 1 is fully folded up. The up side 16' arranged in the area of the second side edge 12' is formed by a bent over section of the base part 2 with a cover film 6 sealed onto it. Folding it over onto the other side causes the recess opening 4 to lie over a push-through area in the cover layer 7 (not shown in FIG. 3), in the same way as in the above embodiment variant.

The second alternative is especially suitable for push-through packs 1 and base parts 2 with a number of recesses 3 (FIG. 4). The base part 2 in this case is subdivided into surface elements 5, where a recess 3 is assigned to each surface element 5. The base part 2 comprises for example two lines 14 of recesses 3 or surface elements 5. Each surface element 5 has separable connection seams 13 on both sides, where two separable connection seams 13, each assigned to an adjacent surface element 5, which are mutually bordered by a weakening line 10', run along the centre of two lines 14. In order to separate individual portions or surface elements 5 from the remainder of the base part 2, the surface element 5 can be detached direct from its separable connection seam 13 located between two lines 14 or else separated together with this from the remainder of the base part 2.

In the case of blister packs of several such linked surface elements 5, the fourth fold line 9'" is located in the surface element 5 itself, in the same way as in the second alternative described above, so that the cover layer 7 does not have any section extending beyond the side edge 12" of the surface element 5.

In order to remove the contents from the individual recesses 3, individual surface elements 5 are separated along the weakening line or perforation 10' from the remainder of the base part 2. After separation of the separable connection seams 13 along the weakening lines 10, the recess opening 4 may be displaced onto the push-through section in cover layer 7 by folding up the cover layer 7 in the manner of a parallelogram.

What is claimed is:

1. A push-through pack (1) containing a base part (2) comprising at least one surface element (5) and at least one recess (3), a push-through cover film (6) fixed to the base part (2) and covering at least the recess opening (4) of the recess (3), and a cover layer (7) which overlays the cover film (6) on the outside, and the cover layer (7) contains non-push-through and push-through sections and the recess (3) is located at least partially over a non-push through section in the cover layer (7) when the push-through pack (1) is undisturbed, and means are arranged to release the content by way of which means the recess opening (4) can be brought over a push-through section (8) in the cover layer (7) by movement relative to the cover layer (7) so that the content can be pushed through the cover film (6) and the push-through section (8) in the cover layer (7), the cover layer (7) is connected at two opposing side edges (12, 12') or side edge areas of the surface element (5) to the base part (2) and contains fold lines (9, 9', 9", 9'") at which the cover layer (7) can be shifted and folded up in the manner of a parallelogram by a movement relative to the surface element (5), so that when folded up the recess opening (4) comes to lie on a push-through section (8) in the cover layer (7).

2. The push-through pack according to claim 1, wherein the push-through pack (1) comprises a surface element (5) with a recess (3) or is divided into several surface elements (5) each with a recess (3), where a cover layer (7) is assigned to each surface element (5) or to a group of surface elements (5), and the surface elements (5) are mutually bordered by way of weakening lines (10') and means are provided by way of which each recess (3) can be pushed individually over the push-through section in the cover layer (7).

3. The push-through pack according to claim 2, wherein the several surface elements (5) are evenly arranged.

4. The push-through pack according to claim 2, wherein the cover layer (7) is made of a material cut-out.

5. The push-through pack according to claim 1, wherein the cover layer (7) forms a connection (13) with the base part (2) at least at one side edge (12) or side edge area of the surface element (5), so that the recess (3) cannot be displaced relative to the cover layer (7) until after detachment or removal of the connection (13).

6. The push-through pack according to claim 1, wherein the cover layer (7) is connected to the base part (2) at two opposing side edges (12, 12') or side edge areas of the surface element (5), and at least the cover layer (7) contains fold lines (9, 9', 9", 9'"), at which the cover layer (7) can be folded up by a movement relative to the surface element (5) in the manner of a parallelogram, and the cover layer (7) and the surface element (5) enclose a space, viewed in cross section, in the fully folded up position, and when folded over to the other side, the recess opening (4) comes to lie over a push-through section in the cover layer (7).

7. The push-through pack according to claim 6, wherein the cover layer (7) and the surface element (5) contain fold lines (9, 9', 9", 9'").

8. The push-through pack according to claim 6, wherein a first and second fold line (9, 9') are arranged along a first side edge and a second opposite side edge (12, 12') in the cover layer (7) or in the base part (2) and a third and fourth fold line (9", 9'") are located in the cover layer (7) or in the base part (2), each offset by the length of an up side (16, 16') from the first or second side edge (12, 12').

9. The push-through pack according to claim 8, wherein the connection (13) is a glued or sealed connection and is a side edge area in the surface element bordered by a weakening line (10) and is detachable along the weakening line.

10. The push-though pack according to claim 8, wherein the surface element is bordered by a perforation and detachable along the perforation.

11. The push-through pack according to claim 1, wherein the push-through section (8) in the cover layer (7) is a partially or fully enclosed section provided with a weakening line (10), a recess or a section provided with a push-through foil, layer, composite foil or composite layer.

12. The push-through pack according to claim 11, wherein the weakening line (10) is a perforation.

13. The push-through pack according to claim 11, wherein the cover film (6) comprises an aluminum foil of a thickness of 15 to 30 mm coated with a hot seal lacquer.

14. The push-through pack according to claim 1 wherein the base part (2) and/or the cover layer (7) is a composite foil with an external foil made of PVC of a thickness of 60 to 100 mm, with a further external foil made of oriented polyamide (oPA) of a thickness of 25 to 30 mm and of an intermediate foil made of aluminum of a thickness of 45 to 60 mm.

15. A process comprising using the push-through pack according to claim 1 as medicine packing.

* * * * *